US006371817B1

(12) United States Patent
Shi et al.

(10) Patent No.: US 6,371,817 B1
(45) Date of Patent: Apr. 16, 2002

(54) ELECTRICAL CONNECTOR HAVING RELIABLY POSITIONED TERMINALS AND MOLD FOR MANUFACTURING THE SAME

(75) Inventors: GuangXing Shi; Qiang Chen; Qijin Hao, all of Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/812,539

(22) Filed: Mar. 19, 2001

(30) Foreign Application Priority Data

Dec. 21, 2000 (TW) ..... 89222263 U

(51) Int. Cl.[7] ..... H01R 33/60
(52) U.S. Cl. ..... 439/660; 439/736
(58) Field of Search ..... 439/660, 736, 439/79

(56) References Cited

U.S. PATENT DOCUMENTS 5,772,474 A * 6/1998 Yagi et al. ..... 439/660
5,795,194 A * 8/1998 Hahn ..... 439/660
5,902,136 A * 5/1999 Lemke et al. ..... 439/660
6,004,160 A * 12/1999 Korsunsky et al. ..... 439/736
6,036,549 A * 3/2000 Wulff ..... 439/736
6,083,051 A * 7/2000 Chang ..... 439/660
6,099,359 A * 8/2000 Yamamuro ..... 439/660
6,176,748 B1 * 1/2001 Simmel et al. ..... 49/660

* cited by examiner

*Primary Examiner*—Gary Paumen
(74) *Attorney, Agent, or Firm*—Wei Te Chung

(57) ABSTRACT

An electrical connector including a dielectric base (11) and a dielectric tongue (123) projecting upwardly from the base, a number of terminals (20) insert molded in the tongue, and a pair of sidewalls (130). Each terminal has a body (21) secured on a side of the tongue for electrically engaging with a contact of the complementary connector, a tail (22) extending downwardly from the body and embedded in the base with a soldering section (221) thereof protruding from the base for soldering on a printed circuit board, and a head (26) extending upwardly from the body and embedded in the tongue. The tongue defines a number of apertures (122) in opposite sides thereof alternating with the bodies of the terminals. The apertures extend into the tongue for receiving positioning blocks (42) formed on a mold (4). The positioning blocks are used to catch lateral sides of the terminals for positioning the terminals when the terminals are subject to insert molding process.

1 Claim, 9 Drawing Sheets

ELECTRICAL CONNECTOR HAVING RELIABLY POSITIONED TERMINALS AND MOLD FOR MANUFACTURING THE SAME

BACKGROUND OF THE INVENTION

1. Field of the Invention

The present invention relates to an electrical connector and to a mold for molding a housing of the electrical connector, and particularly to an electrical connector having a housing molded with an improved mold wherein terminals of the electrical connector are reliably positioned in the housing.

2. Description of Related Art

A conventional electrical connector, as indicated in FIG. 9, is seated in a mold 7. The conventional connector provides a dielectric housing 8 and a plurality of terminals 9 secured in the housing 8. The housing 8 is converted T-shaped and has an upper blade 82. The terminals 9 each have an engaging portion 93 arranged along two opposite sides of the upper blade 82 for electrically contacting with corresponding contacts of a complementary connector (not shown). The engaging portions 93 are substantially flush with the opposite sides of the upper blade 82. The mold 7 provides a pair of walls 70 cooperating with each other to confine a slot 71 therebetween for forming the upper blade 82 with the imbedded engaging portions 93 of the terminals 9. When molten plastic is injected into the mold 7, each engaging portion 93 merely abuts against the walls 70, without any means to catch lateral sides of the engaging portions 93 for restricting lateral movement of the engaging portions 93. Such lateral movement of the engaging portions 93 causes extra molten plastic to deposit on contacting surfaces of the engaging portions 93 which are used to electrically press against the contacts of the complementary connector. In addition, the longlitudinal upper blade 82 deflects while moltenplastic is cooling so that coplanarity of the engaging portions 93 of the same side of the upper blade 82 is degraded. Accordingly, the deformed engaging portions 93 cannot reliably contact with the contacts of the complementary connector.

SUMMARY OF THE INVENTION

One object of the present invention is to provide an electrical connector having terminals accurately secured in position.

Another object of the present invention is to provide a mold for molding a housing of an electrical connector whereby the degree of deformation and coplanarity of terminals is improved.

In order to achieve the objects set forth above, an electrical connector includes a dielectric housing which has a base and a dielectric tongue projecting upwardly from the base, a plurality of terminals insert molded in the tongue, and a pair of sidewalls. Each terminal has a body secured on a side of the tongue with an engaging surface facing outwardly for electrically engaging with a contact of a complementary connector, a tail extending downwardly from the body and embedded in the base with a soldering section protruding from the base for soldering on a printed circuit board, and a head extending upwardly from the body and embedded in the tongue. The tongue defines a plurality of apertures in opposite sides thereof alternating with the bodies of the terminals. The apertures located at one side of the tongue are above those located at the other side of tongue for ensuring the tongue to endure mating force exerted thereon.

The present invention also discloses a mold which has two halves each having a retaining wall, an upper finger, and a lower finger. The retaining walls cooperate to define a recess therebetween for receiving the bodies of the terminals with the engaging surfaces thereof abutting against corresponding retaining walls. A plurality of positioning blocks formed on each half of the mold extends into the recess to catch lateral sides of the terminals for positioning the terminals when the terminals are subject to insert molding process.

Other objects, advantages and novel features of the invention will become more apparent from the following detailed description when taken in conjunction with the accompanying drawings.

DETAILED DESCRIPTION OF THE INVENTION

Figure 1:
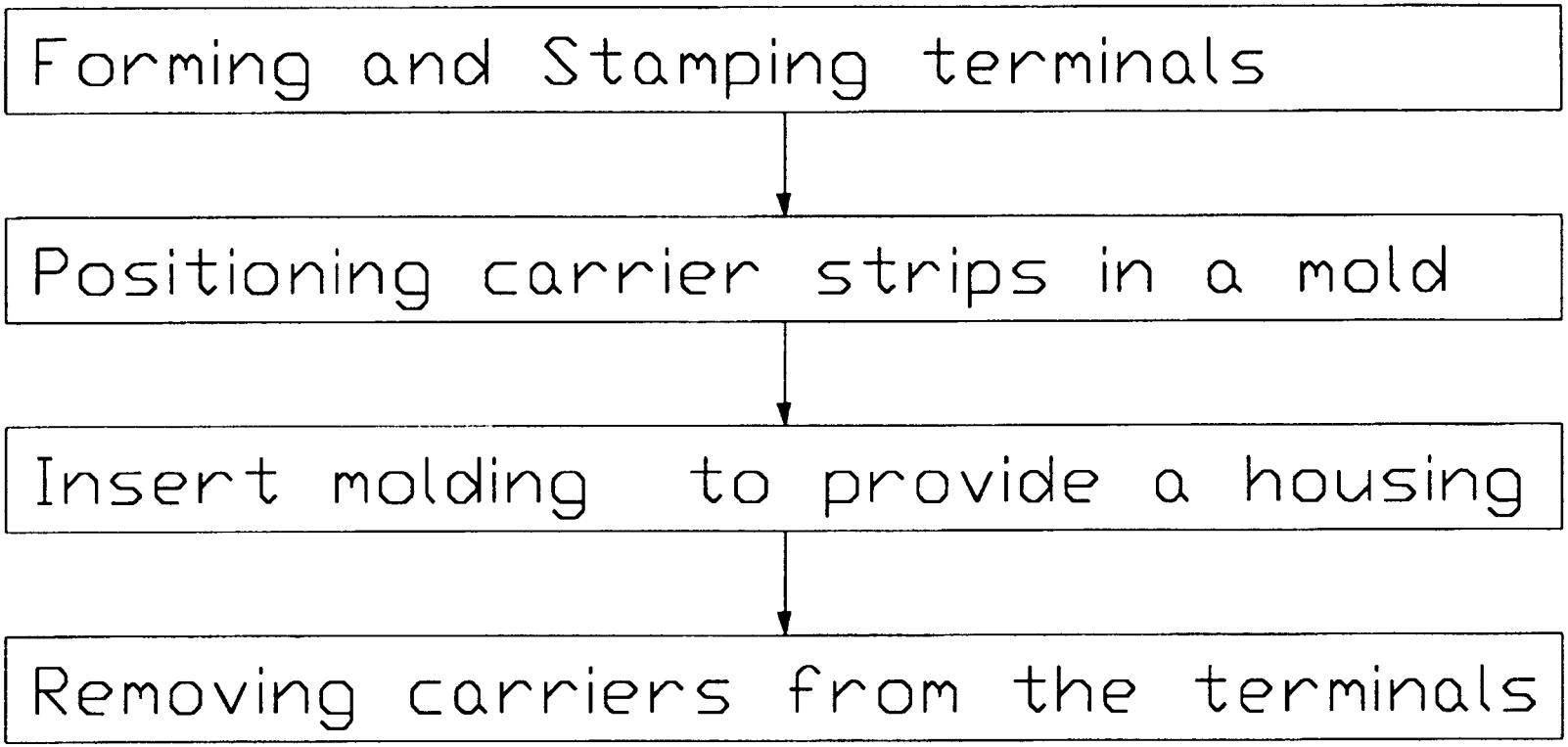
FIG. 1 is a flow chart indicating a method of manufacturing an electrical connector in accordance with the present invention.
Figure 2B:
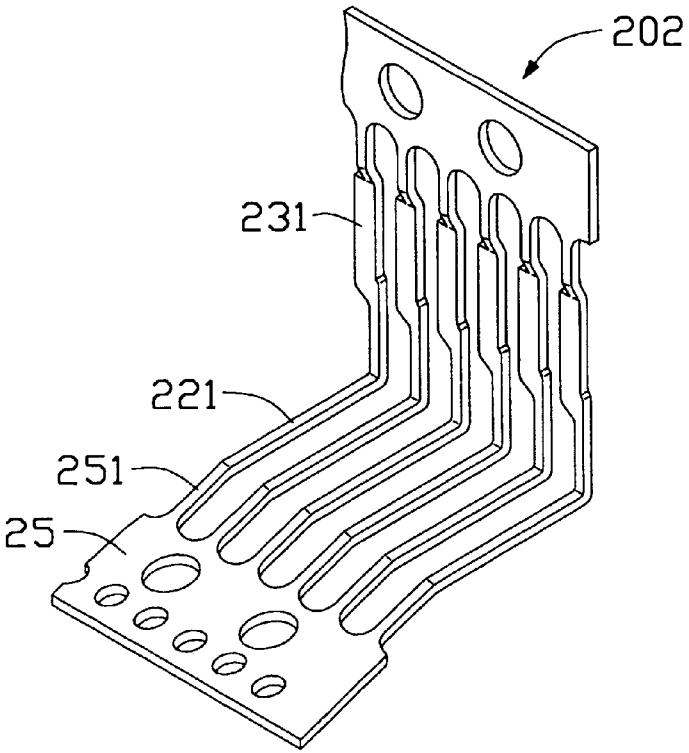
FIG. 2B is similar to FIG. 2A, but showing a second carrier strip.
Figure 2A:
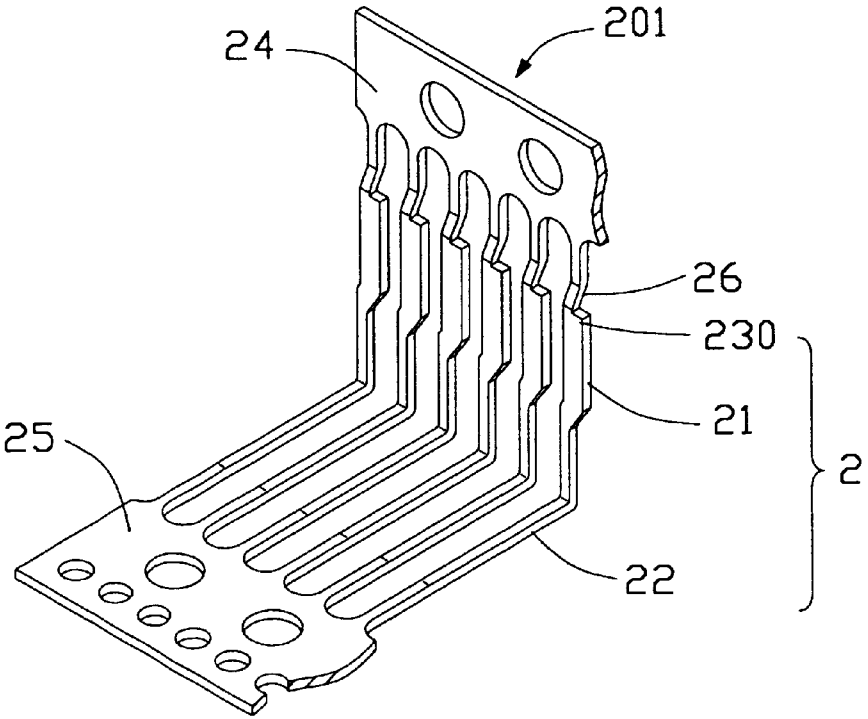
FIG. 2A is a perspective view of a first carrier strip.
Figure 3B:
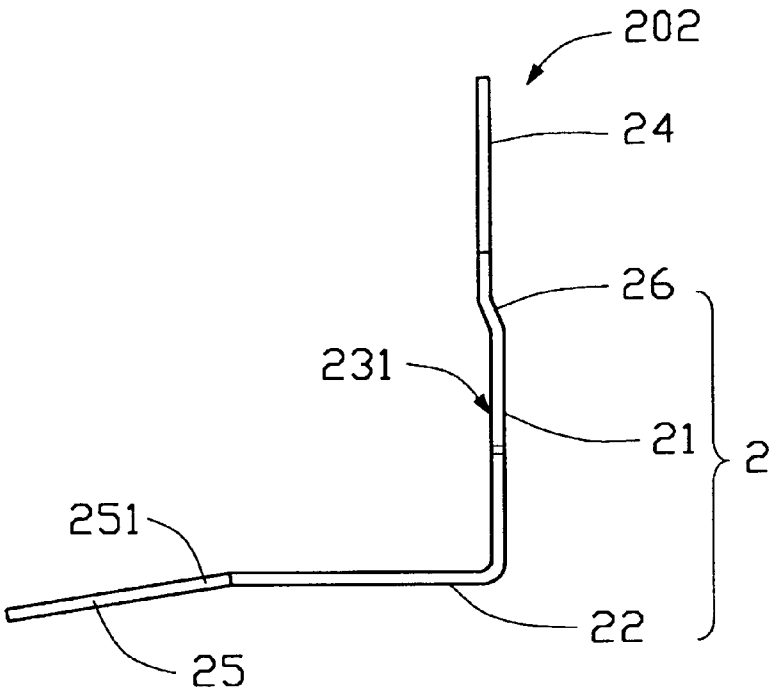
FIG. 3B is a side view of the second carrier strip of FIG. 2B.
Figure 3A:
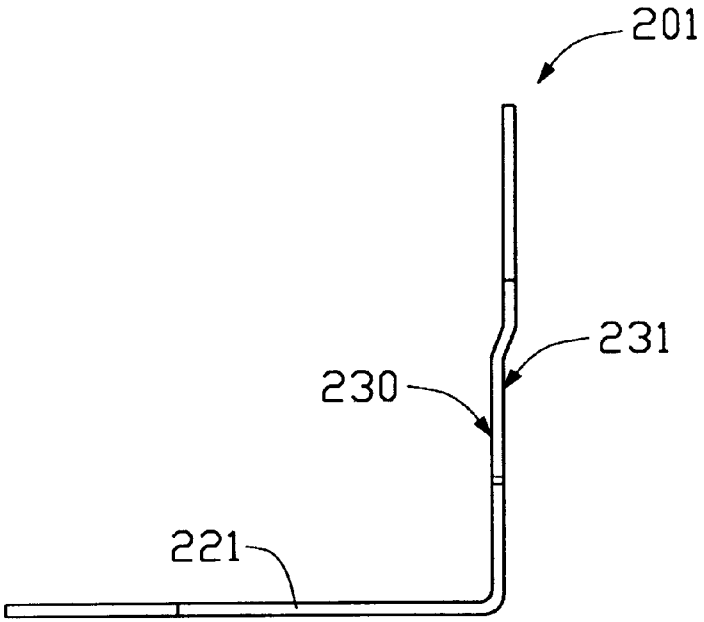
FIG. 3A is a side view of the first carrier strip of FIG. 2A.

Reference will now be made to the drawing figures to describe the: present invention in detail.

Referring to FIG. 1, a method for providing an electrical connector of the present invention follows four steps stamping and forming terminals, positioning terminals in a mold, insert molding to provide a housing, and removing carriers from the terminals.

As shown in FIGS. 2A, 2B, 3A and 3B, the carrier strips 201, 202 are stamped and formed from a metal sheet. Each carrier strip 201, 202 includes an upper carrier 24, a side carrier 25, and a plurality of terminals 2 connecting the upper carrier 24 with the side carrier 25. Each terminal 2 comprises a body 21, a head 26 protruding upwardly and angularly from the body 21, and an L-shaped tail 22 extending downwardly from the body 21. Width of the bodies 21 is substantial double of that of the tails 22 and that of the heads 26. Each body 21 provides an engaging surface 230 and an opposite securing surface 231. The tails 22 of the second carrier strip 202 have soldering sections 221 projecting perpendicularly from the securing surface 231 of the bodies 21 while those of the first carrier strip 201 have soldering sections 221 projecting perpendicularly from the engaging surface 230 of the bodies 21. Each side carrier 25 forms a plurality of stubs 251 each continuing from the tail 22 of corresponding terminal 2. The stubs 251 of the side carrier 25 of the second carrier strip 202 are sloped from the tails 22 at about 6 degree, whereby the upper carrier 24 and the side carrier 25 are located at opposite sides of the tails 22, respectively.

Figure 4:
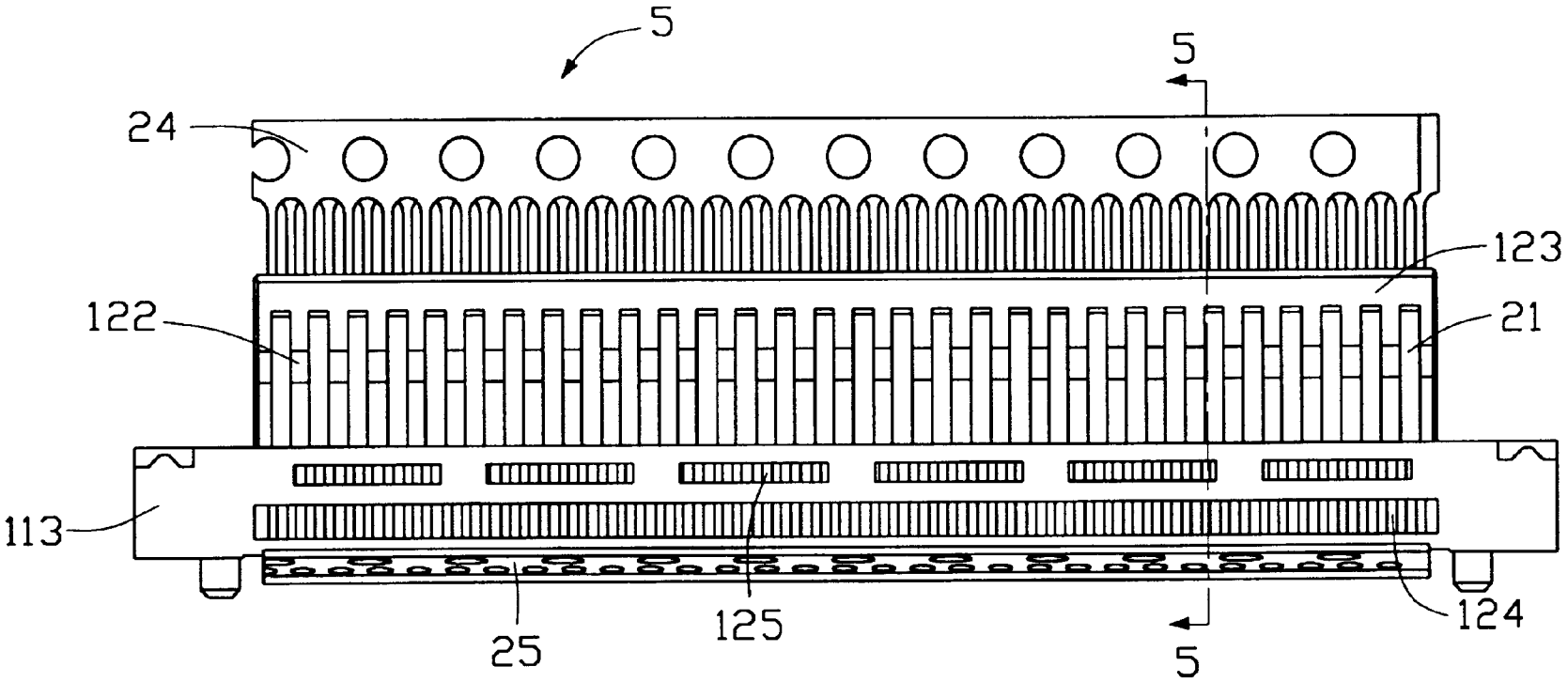
FIG. 4 is a front view of a semi-finished connector.
Figure 5:
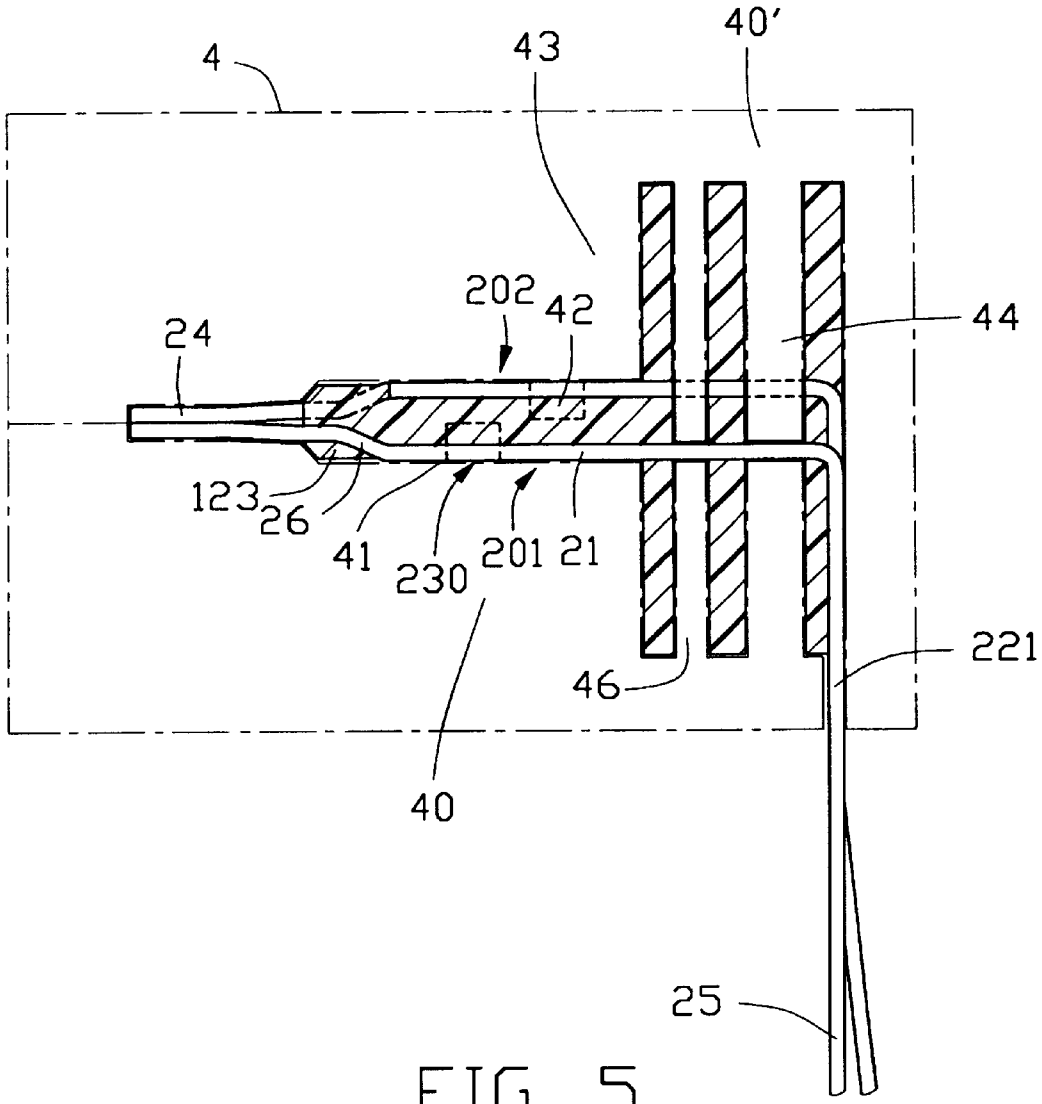
FIG. 5 is a cross-sectional view taken along line 5—5 of FIG. 4.

Referring to FIGS. 4 and 5, the stamped and formed carrier strips 201, 202 are seated in a mold 4 such that the upper carrier 24 and the soldering sections 221 are sandwiched between a first half 40' and a second half 40 of the mold 4. Each half 40, 40' has a retaining wall 43, and a plurality of lower fingers 44 and upper fingers 46. The retaining walls 43 of the halves 40, 40' cooperate to define a recess 41 therebetween. Each retaining wall 43 forms a line of positioning blocks 42 projecting into the recess 41 for a certain depth to reliably clamp lateral sides of the bodies 21 of the terminals 2 which have the engaging surface 230 abutting against the retaining walls 43. The positioning blocks 42 formed on the retaining wall 43 of the second half 40'. In the preferred embodiment, such depth is about half of that of the recess 4. The positioning blocks 42 of a same retaining wall 43 are aligned, each of the positioning blocks 42 of one retaining wall 43 being located above those of the other retaining wall 43, thereby avoiding interference between the positioning blocks 42 of both retaining walls 43. The lower fingers 44 of one half 40 cooperate with corresponding lower fingers 44 of the other half 40 to fix upper portions of the tails 22 therebetween. Similarly, the upper fingers 46 of both halves 40, 40' cooperate to fix portions of the tails 22 above the upper portions. As the tails 22 and the heads 26 are half narrower than the bodies 21 and are located at lateral sides of the bodies 21, when the bodies 21 of two terminals 2 secured face to face on opposite sides of the tongue 123 are aligned and are secured by the positioning blocks 42, the tails 22 and the heads 26 of the first carrier strip 201 are alternately disposed between those of the second carrier strip 202, thereby establishing separate signals transmitting paths via the terminals 2. The tails 22 of the first and second carrier strips 201, 202 are extended toward a same side of the mold 4. Moreover, the sides carrier 25 of the second carrier strip 202 deviates from that of the first second carrier strip 201, thereby facilitating removal of the side carriers 25.

In the preferred embodiment, insert molding process is accomplished by insert molding two times. Referring to FIGS. 4 and 5, molten plastic is firstly inserted into the mold 4 to provide a semi-finished connector 5. When the molten plastic flows across the terminals 2, the terminals 2 are reliably retained by the positioning blocks 42, the upper fingers 46, and the lower fingers 44. In addition, the positioning blocks 42 contribute to average velocity of the molten plastic and to decrease the amount of materials comprising the tongue 123, thereby subjecting the tongue 123 to minimized stress after it is cooled. Accordingly, warping in the tongue 123 is reduced. The semi-finished connector 5 includes an insulative foundation 113, an insulative tongue 123 upwardly projecting from the foundation 113, and the terminals 2 secured in the foundation 113 and the tongue 123. The foundation 113 defines a longitudinal slit 124 by the lower fingers 44 of the halves 40 of the mold 4, and a plurality of through holes 125 by the upper fingers 46 of the halves 40. The slit 124 and the through holes 125 are utilized to reduce material amount of the foundation 113 so that the foundation 113 can be evenly cooled. The tongue 123 in each side thereof defines a line of apertures 122 at lateral sides of the bodies 21 of the terminals 2. The apertures 122 in one side of the tongue 123 are located above those located in the other side of the tongue 123 for ensuring that the tongue 123 can bear mating force applied thereto by a complementary connector (not shown). Each aperture 122 is in fluid communication with the bodies 21 of adjacent terminals 2. The heads 26 are embedded in the tongue 123. The upper carrier 24 of the first and second carrier strips 201, 202 are extended upwardly beyond the tongue 123 and the side carrier 25 of the first and second carrier strips 201, 202 are projected laterally from a same side of the foundation 113, respectively.

Figure 6:
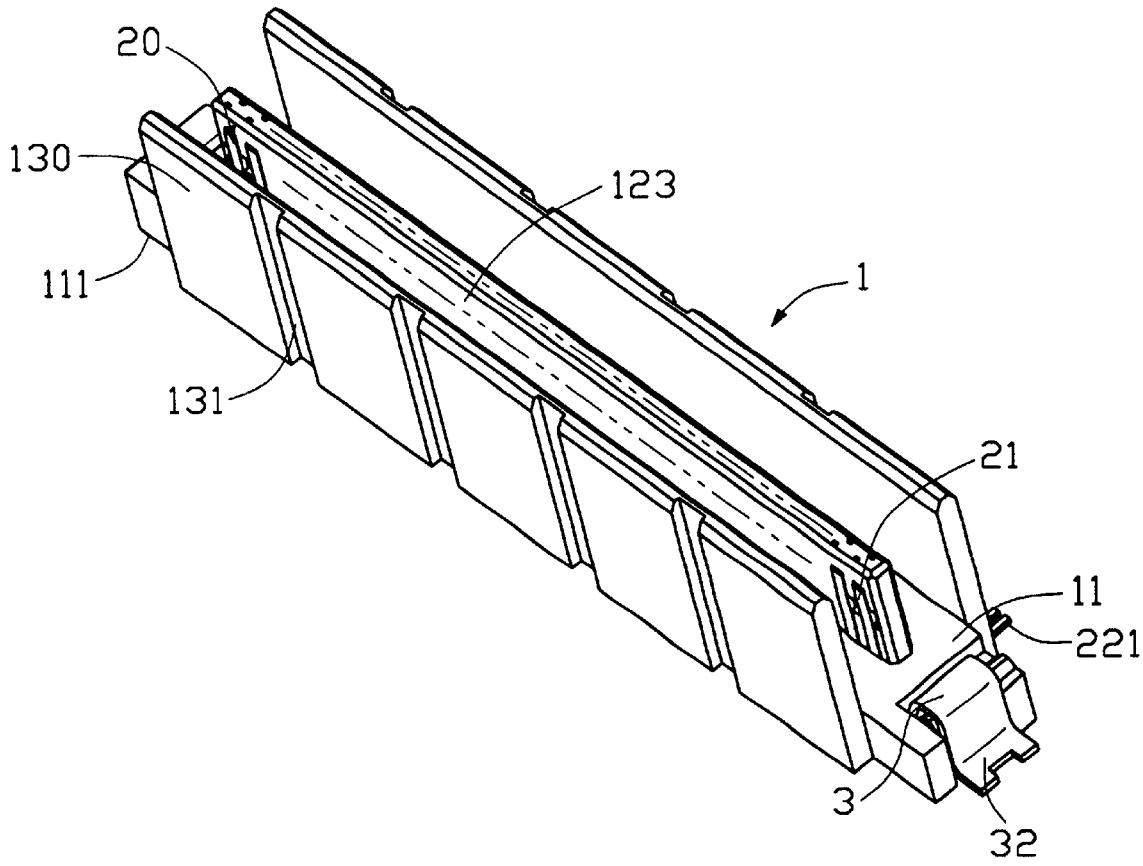
FIG. 6 is a perspective view of the electrical connector.
Figure 7:
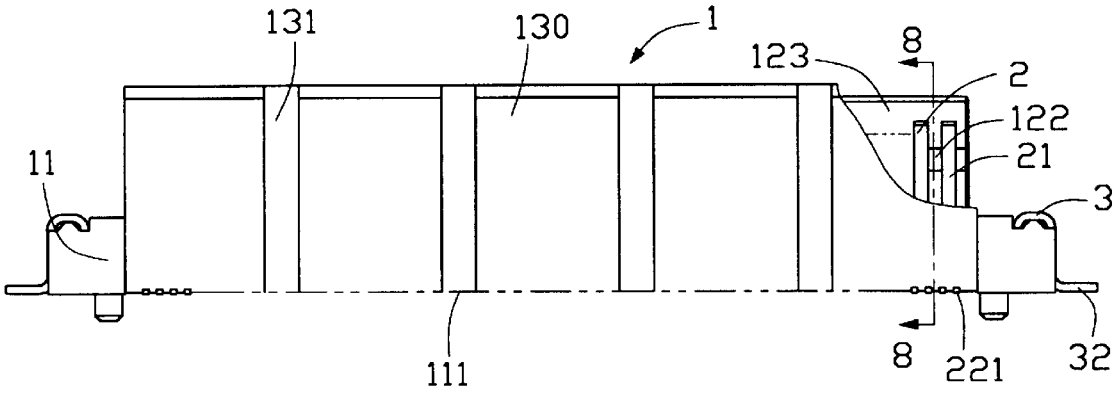
FIG. 7 is a side view of the electrical connector of FIG. 6.
Figure 8:
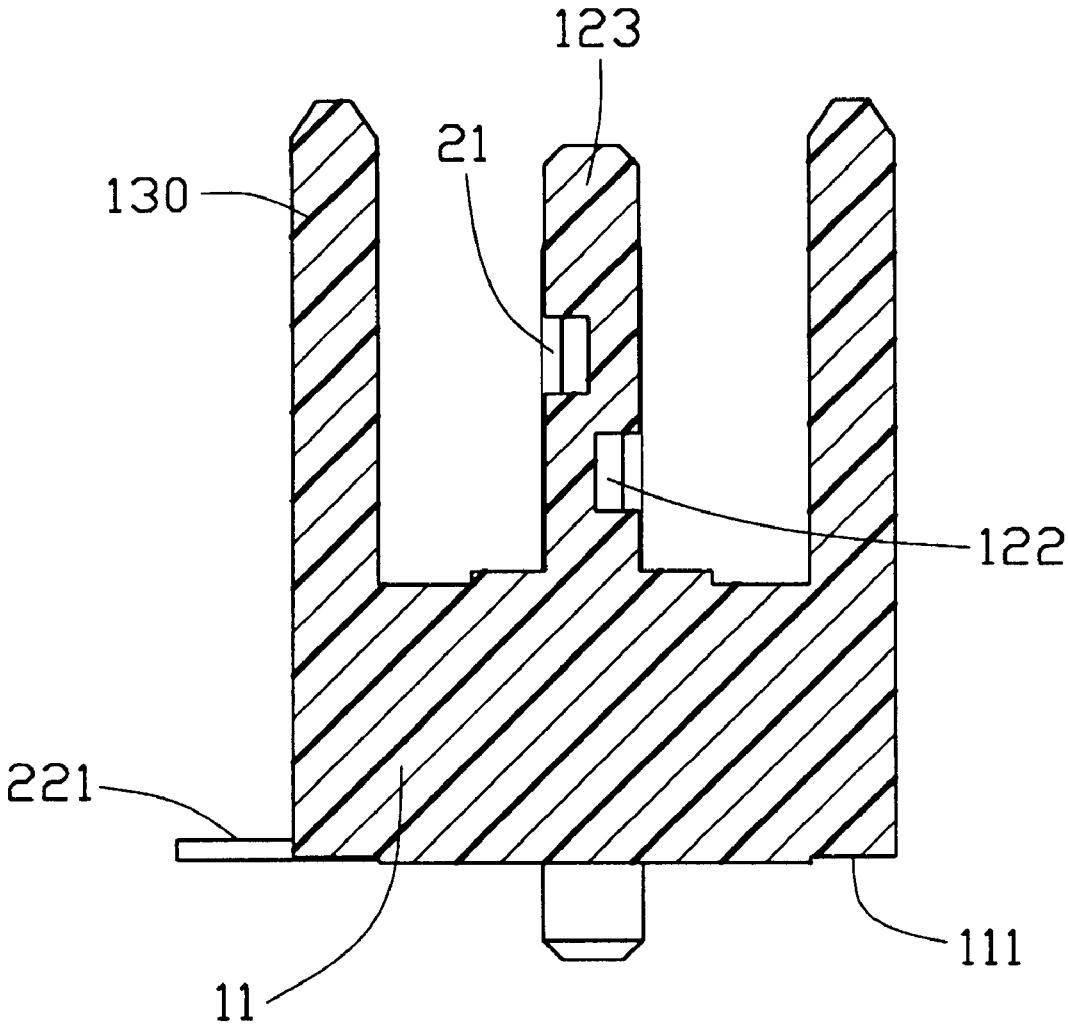
FIG. 8 is a cross-sectional view taken along line 8—8 of FIG. 7.
Figure 9:
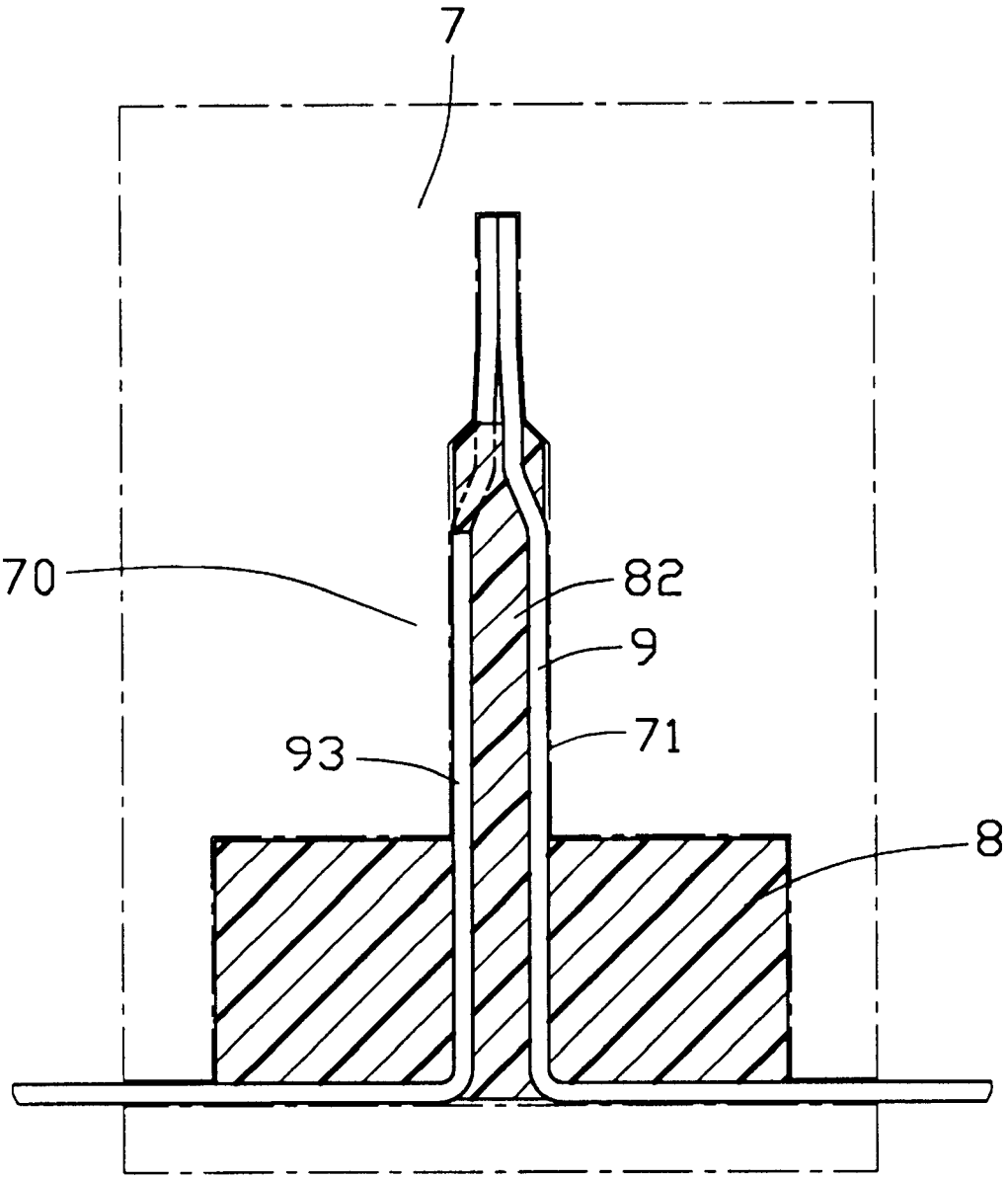
FIG. 9 is a cross-sectional view of a conventional connector.

As indicated in FIGS. 6, 7 and 8, the semi-finished connector 5 is twice insert molded. The slit 124 and the through holes 125 are filled with molten plastic to provide a base 11, in which the tails 22 are embedded. A pair of sidewalls 130 extends from lateral sides of the foundation 113 parallels to the tongue 123. Each sidewall 130 defines vertically extending channels 131 in an outer side thereof for balancing velocity of the molten plastic when the semi-finished connector 5 is subject to insert molding. The soldering sections 221 protrude outwardly from one of the sidewalls 130 for soldering onto a printed circuit board (not shown). A soldering pad 3 is simultaneously insert molded on the base 11. The soldering pad 3 has a foot 32 being flush with a bottom surface 111 of the base 11 for soldering to a ground circuit on the printed circuit board.

Finally, the upper and side carriers 24, 25 are removed to provide a completed connector 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector mounted on a printed circuit board for mating with a complementary connector, comprising:

a dielectric base;

a dielectric tongue projecting upwardly from the base heaving opposite sides; and a plurality of terminals insert molded in the tongue, each terminal having a body secured on a respective side of the tongue for electrically engaging with a contact of the complementary connector, a tail extending downwardly from the body and embedded in the base, the tail having a soldering section protruding from the base for soldering on the printed circuit board, and a head extending upwardly from the body and embedded in the tongue, wherein the tongue has a plurality of apertures in the sides thereof the apertures alternating with the bodies of the terminals;

wherein the apertures in each side of the tongue are aligned in a longitudinal line;

wherein each of the apertures is in fluid communication with the bodies of two adjacent terminals;

wherein each of the apertures is deeper than a thickness of the body of each of the terminals;

wherein the apertures in one side of the tongue are located at a level above those in the other side of the tongue;

wherein the heads and the tails of the terminals located at the one side of the tongue alternate with those of the terminals which are located at the other side of the tongue, respectively, and the bodies of the terminals located at the one side of the tongue are aligned with those of the corresponding terminals located at the other side of the tongue;

the electrical connector further comprising a pair of sidewalls extending from the base parallel to the tongue, each of the sidewalls having in an outer side thereof a plurality of vertical channels for equalizing a respective velocity of molten plastic flowing therethrough during fabrication of the electrical connector.

* * * * *